AIR ADMISSION APPARATUS FOR WATER CONTROL GATE

BACKGROUND OF THE INVENTION

1. Field of the Invention

This invention relates to water control gates such as crest gates. In particular, this invention relates to apparatus for admitting air to the downstream side of the gate for abating vibration caused by water spilling over the top of the gate.

2. Description of the Prior Art

Water control gates, such as crest gates, for controlling the flow of water through a waterway are well known. Examples of water control gates are found in U.S. Pat. No. 2,621,484 to Jermar dated Dec. 16, 1952; U.S. Pat. No. 2,073,956 to Becher dated Mar. 16, 1937 and U.S. Pat. No. 2,077,203 to Becher dated Apr. 13, 1937. Such gates have a bottom portion which are pivotally mounted to the floor of the waterway with the gate extending between sidewalls of the waterway. The gate is pivoted between a closed position with the gate generally vertical and an open position with the gate pivoted toward the downstream waterflow. Generally, such gates are used to maintain a constant water level on the upstream side of the gate.

When in any given pivotal position, a curtain of water flows over the top of the gate. When a thin curtain of water is passing over the gate, this curtain will vibrate as it falls over the gate. The vibration of this curtain causes low frequency sound waves which can be obnoxious to residents in the surrounding vicinity. The longer the gate, the more obnoxious the sound. When the amount of water flowing over the gate is increased, the curtain of water thickens. The thick curtain of water flowing over the gate cooperates with the gate to define a bounded air chamber on the downstream side of the gate. When pressure differentials occur between atmospheric air and the bounded air chamber, damaging vibrations can occur to the gate. This phenomena is recognized in U.S. Pat. No. 2,118,535 to Betts dated May 24, 1938. To prevent these damaging vibrations, prior art water control gates, such as crest gates, were provided with air manifolds built into the sidewall structures of the gate. The air manifolds included piping which permitted air flow communication between the downstream side of the gate and atmospheric air. The sidewall mounted air admission apparatus is effective for water control gates which are mounted on top of dams. An example of such may be found in FIG. 1 of the aforementined U.S. Pat. No. 2,621,484. However, such sidewall mounted manifolds are not operable for water control gates which are mounted on the floor of a waterway. In such cases, there is a variable downstream water level on the downstream side of the gate. The existence of this water level and the stroke of the gate prevent the situation of the manifolds in the sidewalls since there is no practical position with which to admit air to the downstream side of the gate.

It is a general object of the present invention to provide an apparatus for admitting air to a bounded air chamber on the downstream side of a water control gate.

Another object of the present invention is to provide an apparatus for admitting air to the bound air chamber on the downstream of a water control gate which is operable independent of the water level on the downstream side of the gate.

Still another object of the present invention is to provide an apparatus for admitting air to the air chamber on the downstream side of a water control gate which also functions to divide the current of water flowing over the gate into a plurality of smaller curtains and thereby abate sound vibrations.

SUMMARY OF THE INVENTION

According to a preferred embodiment of the present invention, there is provided a water control gate comprising a gate received within a waterway. A bottom portion of the gate is pivotally secured to the floor of the waterway and the gate extends between sidewalls of the waterway. Means are provided for moving the gate between a maximum closed position and an open position. In the maximum closed position, the gate is in a generally vertical position and maintains a water level upstream of the gate at a predetermined desired water level. The gate is rotatable to a plurality of open positions with the gate rotated toward the downstream side of the waterway. Water spilling over the top edge of the gate presents a water current which cooperates with the gate to define a bounded volume of air on the downstream of the gate.

A plurality of air admission pipes are secured to the gate and sized sufficient to extend through the water current with the pipes having a first opening in communication with atmospheric air and a second opening in communication with the bounded volume of air. The plurality of air admission pipes are secured to the gate and divide the current of water flowing over the gate into a plurality of separate water curtains—each shorter than the total length of the gate.

DESCRIPTION OF THE PREFERRED EMBODIMENT

Figure 1:
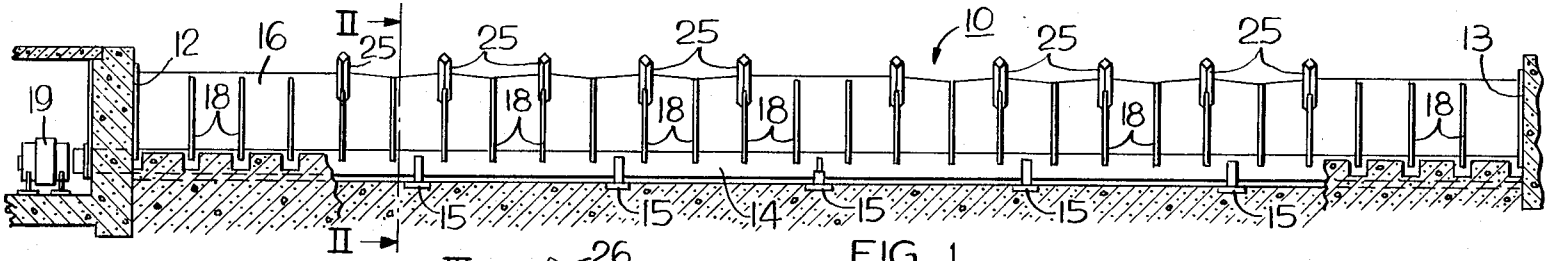
FIG. 1 is an elevational view of a water control gate within a waterway shown partially in section to expose the pivotal connections between the gate and the floor of the waterway.
Figure 3:
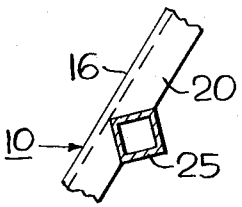
FIG. 3 is a view of the gate taken along lines III—III of FIG. 2.
Figure 2:
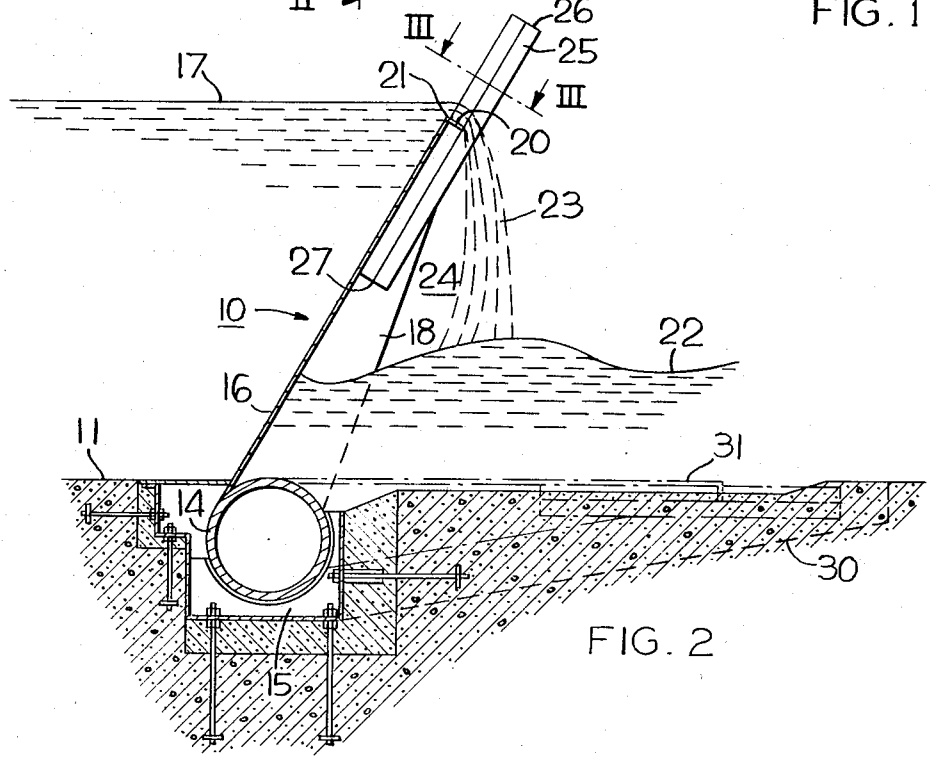
FIG. 2 is a view of a gate taken along lines II—II of FIG. 1.

Referring to FIG. 1, a water control gate 10, more specifically a crest gate, is shown within a waterway. The waterway comprises a floor 11 and two parallel spaced apart sidewalls 12 and 13. The crest gate 10 is sized to be received within the waterway extending between the sidewalls 12 and 13 with a bottom portion of the gate 10 pivotally secured to the floor 11 of the waterway. The gate 10 comprises a torque tube 14 along the bottom edge of the gate which is pivotally secured to the floor 11 of the waterway by means of a plurality of pivotal connections 15. The gate 10 includes a skin plate 16 which extends radially from the torque tube 14 and is provided with a radial dimension sufficient to retain water upstream of the gate at a desired water level 17. A plurality of radially extending reinforcing ribs 18 are laterally spaced along the skin plate 16 and welded thereto to reinforce the skin plate. Means 19 are provided for pivotally rotating the torque tube 14 with resulting rotation of the skin plate 16.

United States Patent [19]

Koga

[11] Patent Number: 4,505,613

[45] Date of Patent: Mar. 19, 1985

[54] METHOD FOR LINING PIPES IN PIPELINES

[75] Inventor: Motoyuki Koga, Tokyo, Japan

[73] Assignee: Hakko Co., Ltd., Tokyo, Japan

[21] Appl. No.: 490,093

[22] Filed: Apr. 29, 1983

[30] Foreign Application Priority Data

| | | | |
|---|---|---|---|
| Apr. 30, 1982 | [JP] | Japan | 57-74335 |
| Apr. 30, 1982 | [JP] | Japan | 57-74336 |
| Apr. 30, 1982 | [JP] | Japan | 57-74337 |
| Apr. 30, 1982 | [JP] | Japan | 57-74338 |

[51] Int. Cl.[3] ..... F16L 55/18

[52] U.S. Cl. ..... 405/154; 118/306; 138/97; 427/236; 427/237; 405/146; 405/150

[58] Field of Search ..... 405/154, 156, 146, 150; 138/97; 118/306; 427/236, 237

[56] References Cited

U.S. PATENT DOCUMENTS

| | | | |
|---|---|---|---|
| 2,634,223 | 4/1953 | Clendenin et al. | 427/237 X |
| 2,914,424 | 11/1959 | Murray | 427/237 |
| 3,096,819 | 7/1963 | White et al. | 427/237 X |
| 3,484,276 | 12/1969 | Burggraaf et al. | 427/237 X |
| 3,578,479 | 5/1971 | Packo | 138/97 X |
| 4,237,172 | 12/1980 | Packo et al. | 138/97 X |
| 4,267,291 | 5/1981 | Jones et al. | 427/237 X |

*Primary Examiner*—Dennis L. Taylor
*Attorney, Agent, or Firm*—Martin A. Farber

[57] ABSTRACT

A method for lining pipes in a town gas underground pipeline. The method is characterized in that carrier air is flown together with plastics mist passing through a route comprising a branch line for distributing the gas to consumers, so that the pipeline and branch pipe are lined with the plastics.

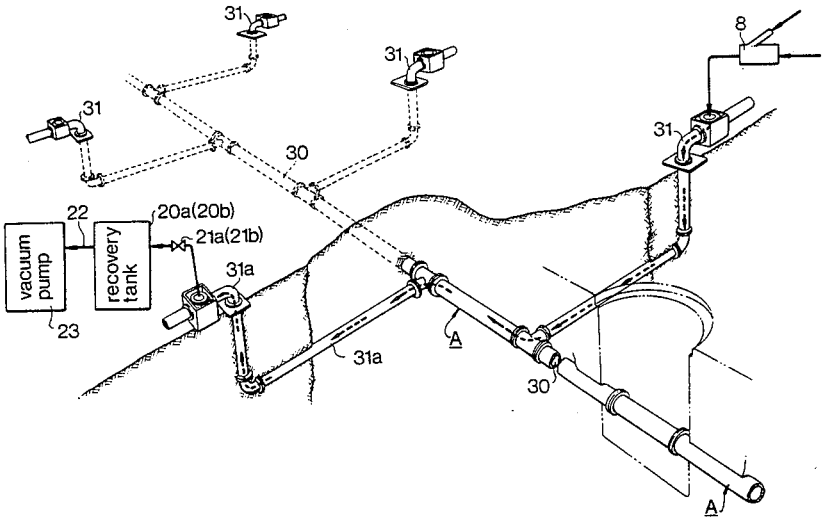

13 Claims, 5 Drawing Figures